US007821484B2

(12) United States Patent
Choi

(10) Patent No.: US 7,821,484 B2
(45) Date of Patent: Oct. 26, 2010

(54) DATA DRIVING CIRCUIT, LIGHT EMITTING DISPLAY DEVICE USING THE SAME, AND DRIVING METHOD THEREOF

(75) Inventor: Sang Moo Choi, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1008 days.

(21) Appl. No.: 11/517,762

(22) Filed: Sep. 8, 2006

(65) Prior Publication Data

US 2007/0097046 A1 May 3, 2007

(30) Foreign Application Priority Data

Oct. 31, 2005 (KR) ..... 10-2005-103299

(51) Int. Cl.
*G09G 3/36* (2006.01)

(52) U.S. Cl. ..... 345/98; 345/100

(58) Field of Classification Search ..... 345/98, 345/100; 327/94–98
See application file for complete search history.

(56) References Cited

U.S. PATENT DOCUMENTS

| | | | | |
|---|---|---|---|---|
| 5,856,816 | A * | 1/1999 | Youn | 345/98 |
| 6,441,758 | B1 * | 8/2002 | Koyama et al. | 341/136 |
| 6,525,710 | B1 * | 2/2003 | Kwon | 345/100 |
| 6,618,031 | B1 * | 9/2003 | Bohn et al. | 345/83 |
| 6,664,943 | B1 * | 12/2003 | Nakajima et al. | 345/98 |
| 7,173,592 | B2 * | 2/2007 | Yamashita et al. | 345/98 |
| 7,193,588 | B2 * | 3/2007 | Lo | 345/76 |
| 7,199,771 | B2 * | 4/2007 | Yamazaki et al. | 345/84 |
| 7,239,300 | B2 * | 7/2007 | Shimizu | 345/100 |
| 7,557,780 | B2 * | 7/2009 | Kimura | 345/76 |
| 2006/0139286 | A1 * | 6/2006 | Kida et al. | 345/98 |
| 2008/0170027 | A1 * | 7/2008 | Kyeong et al. | 345/100 |

FOREIGN PATENT DOCUMENTS

| | | |
|---|---|---|
| JP | 10-161086 | 6/1998 |
| KR | 2002-0003274 | 1/2002 |
| KR | 10-2004-0068729 | 8/2004 |

OTHER PUBLICATIONS

Patent Abstract of Japan for Japanese Publication No. 10-161086, published Jun. 19, 1998 in the name of Yutaka Minamino, et al.

(Continued)

*Primary Examiner*—Chanh Nguyen
*Assistant Examiner*—Kwang-Su Yang
(74) *Attorney, Agent, or Firm*—Christie, Parker & Hale, LLP

(57) ABSTRACT

A data driver in which the size of the data driving circuit is reduced or minimized so as to be applied to a high-resolution panel. The data driving circuit includes a plurality of shift registers for generating first sampling signals; a plurality of sampling latches arranged as first sampling latches and second sampling latches, the sampling latches being adapted to receive data when the first sampling signals are supplied; and a plurality of holding latches controlled by a first source output enable signal and a second source output enable signal, the holding latches being adapted to receive the data stored in the sampling latches, wherein the data stored in the first sampling latches is supplied to the holding latches via the second sampling latches.

21 Claims, 8 Drawing Sheets

OTHER PUBLICATIONS

Korean Patent Abstract for Korean Publication No. 1020040068729 A, published Aug. 2, 2004 in the name of Dong II Jung.

Korean Patent Abstract for Korean Publication No. 1020020003274 A in the name of Nozomu Harada, et al.

* cited by examiner

DATA DRIVING CIRCUIT, LIGHT EMITTING DISPLAY DEVICE USING THE SAME, AND DRIVING METHOD THEREOF

CROSS-REFERENCE TO RELATED APPLICATION

This application claims priority to and the benefit of Korean Patent Application No. 10-2005-0103299, filed on Oct. 31, 2005, in the Korean Intellectual Property Office, the entire content of which is incorporated herein by reference.

BACKGROUND

1. Field of the Invention

The present invention relates to a data driving circuit, a light emitting display device using the same and a driving method thereof, and more particularly, to a data driving circuit, a light emitting display device using the same and a driving method thereof, in which the size of the data driving circuit is reduced or minimized, such that it can be applied to a high-resolution panel.

2. Discussion of Related Art

An organic light emitting display device employs organic light emitting diodes (OLEDs) capable of emitting light based on electron-hole recombination, thereby displaying an image. The organic light emitting display device has advantages of relatively fast response time and relatively low power consumption. In general, the organic light emitting display device includes a driving transistor provided per pixel, and uses the driving transistor to supply a current corresponding to a data signal to the OLEDs, thereby allowing the OLEDs to emit light.

The organic light emitting display device generates data signals based on external data, and transmits the data signals to the pixels, thereby displaying an image with desired brightness. To convert the external data into the data signals, the organic light emitting display device employs at least one data driving circuit.

SUMMARY OF THE INVENTION

Accordingly, it is an aspect of the present invention to provide a data driving circuit, a light emitting display device using the same and a driving method thereof, in which the size of the data driving circuit is reduced such that it can be applied to a high-resolution panel.

According to an exemplary embodiment of the present invention, a data driving circuit includes a plurality of shift registers for generating first sampling signals; a plurality of sampling latches arranged as first sampling latches and second sampling latches, the sampling latches being adapted to receive data when the first sampling signals are supplied; and a plurality of holding latches controlled by a first source output enable signal and a second source output enable signal, the holding latches being adapted to receive the data stored in the sampling latches, wherein the data stored in the first sampling latches is supplied to the holding latches via the second sampling latches.

According to an embodiment of the invention, a $j^{th}$ one of the first sampling signals is supplied to overlap with a $(j-1)^{th}$ one of the first sampling signals for a period.

According to an embodiment of the invention, a first portion of the data is supplied to a $(j-1)^{th}$ one of the second sampling latches via a $j^{th}$ one of the first sampling latches when the $j^{th}$ one of the first sampling signals is overlapped with the $(j-1)^{th}$ one of the first sampling signals, and a second portion of the data is supplied to the $j^{th}$ one of the first sampling latches when only the $j^{th}$ one of the first sampling signals is supplied.

According to an embodiment of the invention, the holding latches include a plurality of first holding latches placed in an first area, the first holding latches being adapted to receive the data from the first sampling latches; and a plurality of second holding latches placed in a second area, the second holding latches being adapted to receive the data from the second holding latches.

According to an embodiment of the invention, the second holding latches receive the data stored in the second sampling latches via the first holding latches when the first source output enable signal and the second source output enable signal maintain a first polarity.

According to an embodiment of the invention, a second sampling signal is supplied to the second sampling latches while being at least partially overlapped with the first source output enable signal in the first polarity after storing the data in the second holding latches.

According to an embodiment of the invention, the data stored in the first sampling latches is supplied to the first holding latches via the second sampling latches while the second sampling signal and the first source output enable signal are overlapped in the first polarity.

According to an embodiment of the invention, after storing the data in the first and second holding latches, the data stored in the first holding latches is supplied to a digital-analog converter while the first source output enable signal and the second source output enable signal maintain a second polarity, and the data stored in the first holding latches is supplied to the digital-analog converter via the second holding latches when the second source output enable signal maintains the first polarity.

According to an exemplary embodiment of the present invention, a light emitting display device includes: a scan driver adapted to supply scan signals to scan lines; a data driver including at least one data driving circuit adapted to supply data signals to data lines; a display region including pixels placed in regions defined by where the scan lines cross the data lines, the pixels being adapted to generate light corresponding to the data signals, the at least one data driving circuit including: a plurality of shift registers for generating sampling pulses; a plurality of sampling latches arranged as first sampling latches and second sampling latches, the sampling latches being adapted to receive data when the sampling pulses are supplied; and a plurality of holding latches arranged as first holding latches and second holding latches, the holding latches being adapted to receive the data stored in the sampling latches, wherein the data stored in the first sampling latches is supplied to the first holding latches via the second holding latches.

According to an embodiment of the invention, a portion of the data stored in at least one of the second sampling latches is supplied to a corresponding one of the second holding latches via a corresponding one of the first sampling latches.

According to an embodiment of the invention, the portion of the data stored in the corresponding one of the second holding latches is supplied to a digital-analog converter via a corresponding one of the first holding latches.

According to an exemplary embodiment of the present invention, a method of driving a light emitting display device includes: storing data in first sampling latches and second sampling latches; supplying the data from the first sampling latches to first holding latches via second holding latches; and supplying the data from the second sampling latches to the second holding latches via the first sampling latches.

According to an embodiment of the invention, a portion of the data stored in at least one of the second holding latches is supplied to a digital-analog converter via a corresponding one of the first holding latches.

DETAILED DESCRIPTION

Figure 1:
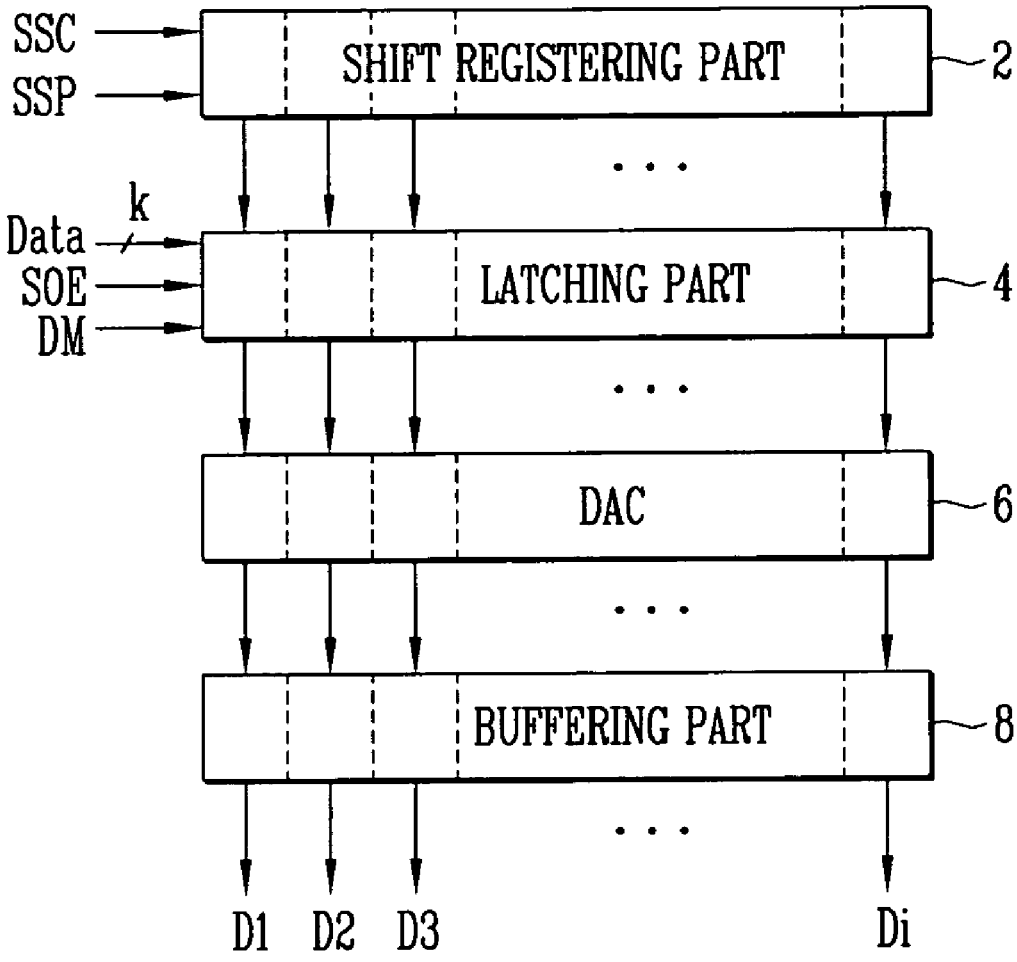
FIG. 1 (PRIOR ART)
FIG. 1 is a schematic block diagram of a conventional data driving circuit.

FIG. 1 schematically illustrates an internal configuration of a conventional data driving circuit.

Referring to FIG. 1, the conventional data driving circuit includes a shift registering part 2; a latching part 4; a digital-to-analog converter (DAC) 6; and a buffering part 8.

The shift registering part 2 receives a source shift clock SSC and a source start pulse SSP from the outside. In other words, the SSC and SSP signals are externally supplied. After receiving the source shift clock SSC and the source start pulse SSP, the shift registering part 2 shifts the source start pulse SSP per one period of the source shift clock SSC and generates i sampling signals in sequence. For this, the shift registering part 2 includes i shift registers (where i is a natural number).

The latching part 4 receives k bit data from the outside while the sampling signal is supplied, and temporarily stores the received data therein (where k is a natural number). Further, the latching part 4 outputs the temporarily stored data while a source output enable (SOE) signal is supplied. Here, the latching part 4 internally includes a demultiplexer, and the demultiplexer controls the output order of the data on the basis of a de-mux control signal DM. The latching part 4 will be described later in more detail.

The DAC 6 generates data signals corresponding to digital values (or gradation values) of the data, and supplies the data signals to the buffering part 8.

The buffering part 8 transmits the data signals from the DAC 6 to data lines D1 through Di.

Figure 2:
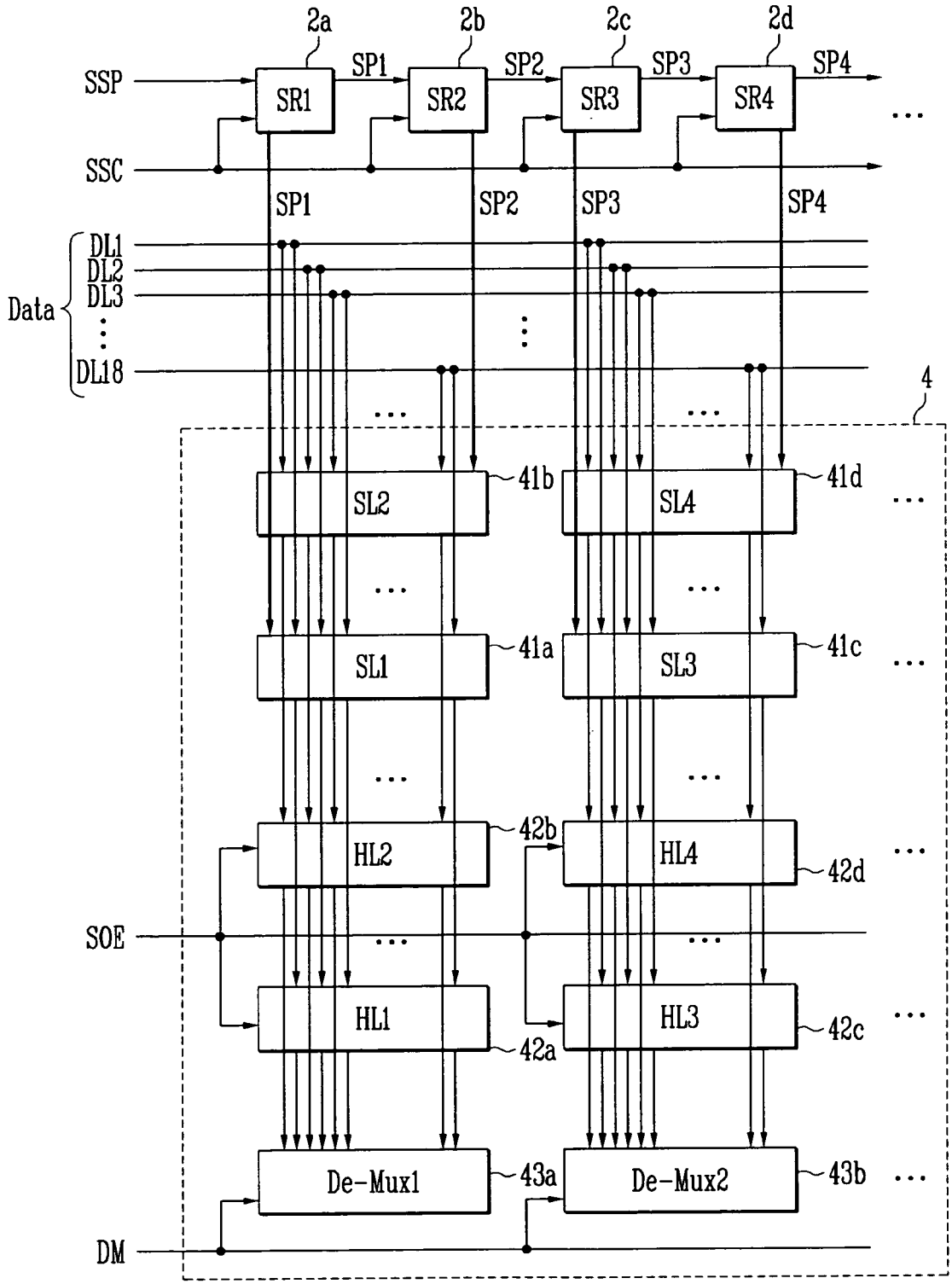
FIG. 2 (PRIOR ART)
FIG. 2 illustrates an example of a latching part shown in FIG. 1.

FIG. 2 illustrates a detailed configuration of the latching part 4 of FIG. 1. For convenience of description, it is assumed that the data Data has 18 bits (i.e., k=18).

Referring to FIG. 2, the conventional latching part 4 includes sampling latches 41*a*, 41*b*, 41*c*, 41*d* (SL1, SL2, SL3, SL4) . . . ; holding latches 42*a*, 42*b*, 42*c*, 42*d* (HL1, HL2, HL3, HL4) . . . ; and de-muxes (or demultiplexers) 43*a*, 43*b*, . . . .

Each of the sampling latches 41*a*, 41*b*, 41*c*, 41*d* . . . receives data of 18 bits from transmission lines DL1, . . . , DL18 while the sampling pulse SP is supplied from the shift registers 2*a*, 2*b*, 2*c*, 2*d* (SR1, SR2, SR3, SR4) . . . . For this, each of the sampling latches 41*a*, 41*b*, 41*c*, 41*d* . . . is set to store the data of 18 bits.

Each of the de-muxes 43*a* and 43*b* is controlled by the de-mux control signal DM and transmits the data Data from two holding latches to the buffering part 8.

Figure 3:
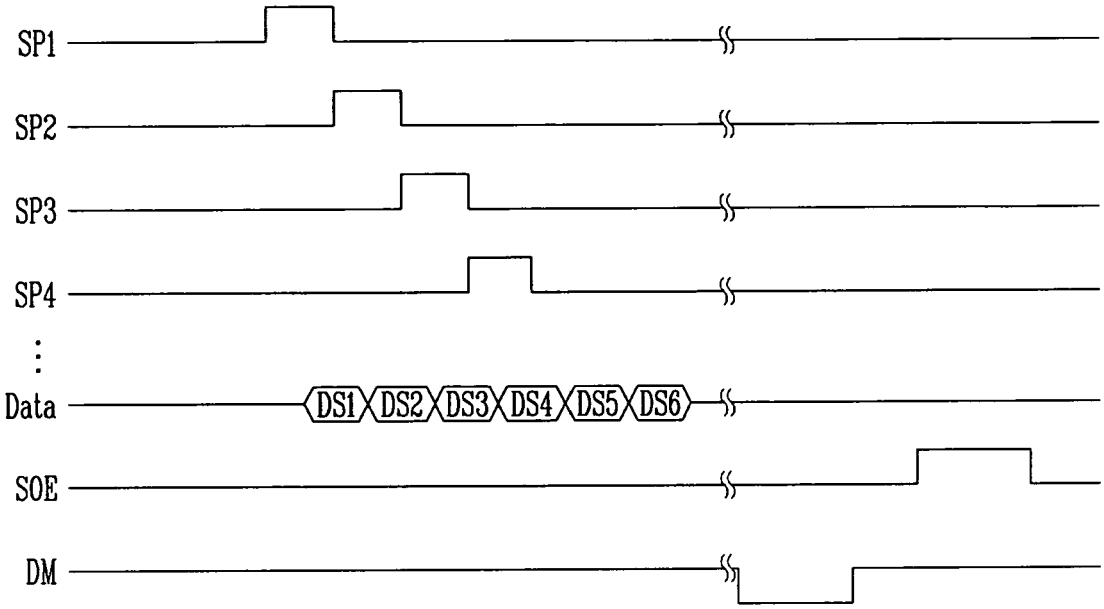
FIG. 3 (PRIOR ART)
FIG. 3 shows waveforms of signals for driving the latching part of FIG. 2.

Referring to waveforms of FIG. 3, operation of the latching part 4 will be described in more detail. The first shift register 2*a* receives the source shift clock SSC and the source start pulse SSP from the outside. Then, the first shift register 2*a* shifts the source start pulse SSP at a certain point (e.g., a rising edge or a falling edge) of the source shift clock SSC, thereby generating a sampling pulse SP1.

Then, the second shift register 2*b* shifts the sampling pulse SP1 supplied from the first shift register 2*a* at a certain point of the source shift clock SSC, thereby generating a sampling pulse SP2. Here, the shift registers 2*b*, 2*c*, 2*d* other than the first shift register 2*a*, generate the sampling pulses SP at the certain points of the source shift clock SSC when the sampling pulses SP are supplied from the respective previous shift registers, and supply them to the subsequent shift registers, respectively.

The first sampling latch 41*a* receives the data Data from the transmission lines DL1, . . . , DL18 when the sampling pulse SP1 is supplied from the first shift register 2*a*. Further, the second sampling latch 41*b* placed between the first sampling latch 41*a* and the transmission lines DL1, . . . , DL18 receives the data Data from the transmission lines DL1, . . . , DL18 when the sampling pulse SP2 is supplied from the second shift register 2*b*.

Likewise, the third sampling latch 41*c* receives the data Data from the transmission lines DL1, . . . , DL18 when the sampling pulse SP3 is supplied from the third shift register 2*c*. Further, the fourth sampling latch 41*d* placed between the third sampling latch 41*c* and the transmission lines DL1, . . . , DL18 receives the data Data from the transmission lines DL1, . . . , DL18 when the sampling pulse SP4 is supplied from the fourth shift register 2*d*.

The de-mux control signal DM remains at a high level while the data Data is stored in the sampling latches 41*a*, 41*b*, 41*c*, 41*d* . . . . Then, the data Data stored in the even numbered holding latches 42*b*, 42*d* for the previous period is supplied to the DAC 6 via the de-muxes 43*a*, 43*b*, . . . . After the data Data is stored in the sampling latches 41*a*, 41*b*, 41*c*, 41*d* . . . , the de-mux control signal DM is changed to have a low level. Then, the data Data stored in the odd numbered holding latches 42*a*, 42*c*, . . . for the previous period is supplied to the DAC 6 via the de-muxes 43*a*, 43*b*, . . . .

Thereafter, the source output enable signal SOE is changed to have a high level. Then, the data Data stored in the sampling latches 41*a*, 41*b*, 41*c*, 41*d* . . . is supplied to the holding latches 42*a*, 42*b*, 42*c*, 42*d* . . . . By way of example, the data Data stored in the first sampling latch 41*a* is supplied to the first holding latch 42*a*, and the data Data stored in the second sampling latch 41*b* is supplied to the second holding latch 42*b*. Further, the data Data stored in the holding latches 42*a*, 42*b*, 42*c*, 42*d* . . . is supplied to the DAC 6 via the de-muxes 43*a*, 43*b*, . . . .

The conventional latching part 4 supplies the data Data to the DAC 6 while repeating the foregoing operations. However, in the conventional latching part 4, the sampling latches 41*a*, 41*b*, 41*c*, 41*d* . . . are placed in an upper part or a lower part (i.e., arranged in two lines or rows), so that there arises a problem in that the number of wiring lines increases. For example, thirty six (36) wiring lines should be arranged between the transmission lines DL1, . . . , DL18 and the sampling latches 41*a*, 41*b* in order to transmit the data of 18 bits.

Likewise, the holding latches 42*a*, 42*b*, 42*c*, 42*d* . . . are conventionally placed in the lower part and the upper part, so that, for example, thirty six (36) wiring lines are arranged between the sampling latches 41*a*, 41*b* and the holding latches 42*a*, 42*b*. Also, thirty six (36) wiring lines are arranged so as to transmit the data Data from the holding latches 42*a*, 42*b* arranged in two rows to the de-mux 43*a*, and thirty six (36) wiring lines are arranged between the holding latches 42*c*, 42*d* and the de-mux 43*b*. Thus, when a large number of wiring lines are internally arranged in the data driving circuit, it is difficult to achieve a highly integrated circuit design and the size of the data driving circuit increases. If the size of the data driving circuit increases, it is difficult to apply this data driving circuit to a high-resolution light emitting display device.

Figure 4:
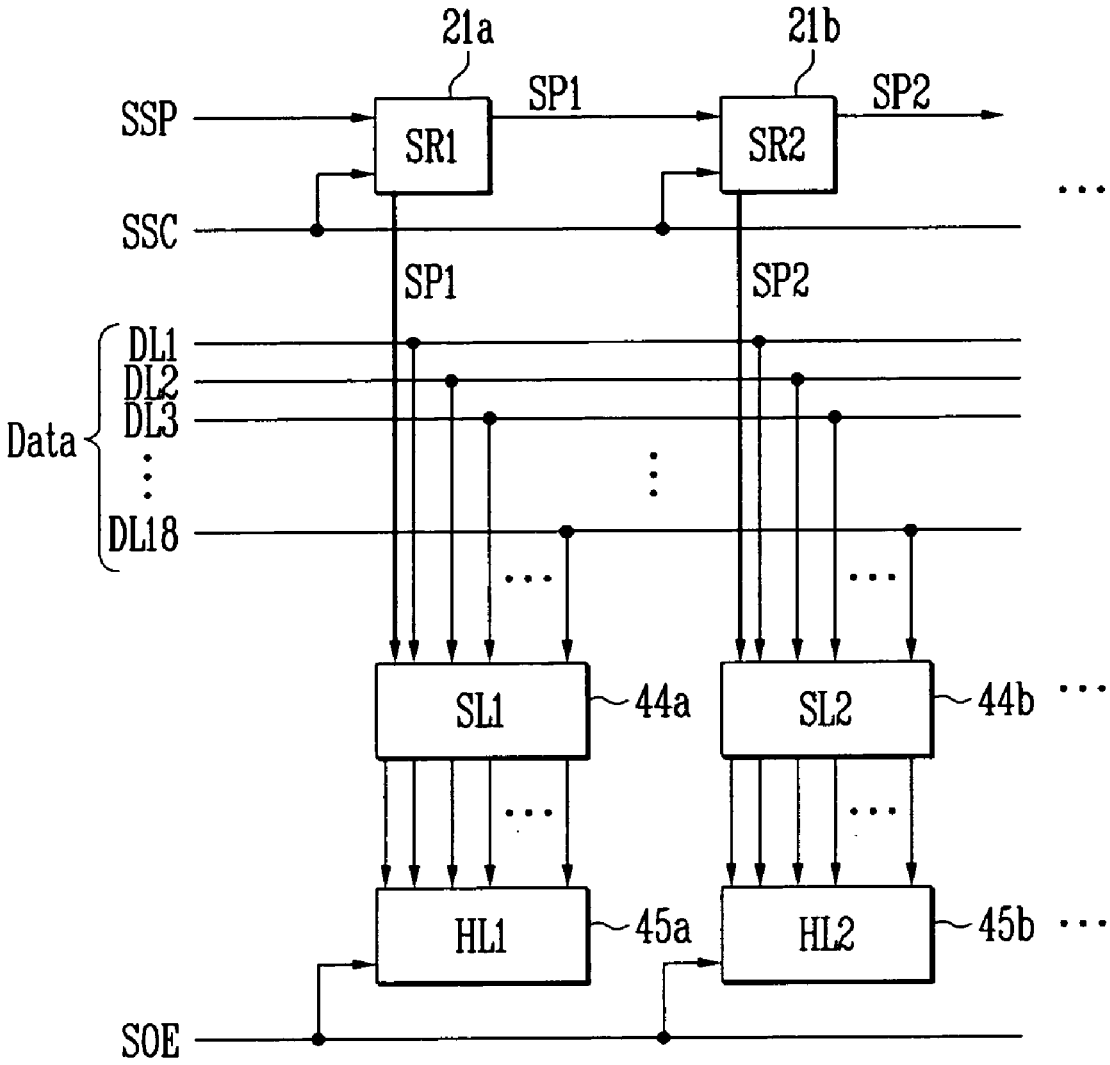
FIG. 4 (PRIOR ART)
FIG. 4 illustrates another example of the latching part shown in FIG. 1.

Alternatively, sampling latches 44*a*, 44*b*, . . . and holding latches 45*a*, 45*b*, . . . of a conventional latching part can be arranged in one row as shown in FIG. 4. However, when the sampling latches 44*a*, 44*b*, . . . and the holding latches 45*a*, 45*b*, . . . are respectively arranged in one row as shown in FIG. 4, a problem arises in that a transverse size of the data driving circuit increases.

Hereinafter, certain exemplary embodiments of the present invention will be described in more detail with reference to FIGS. 5 through 8.

Figure 5:
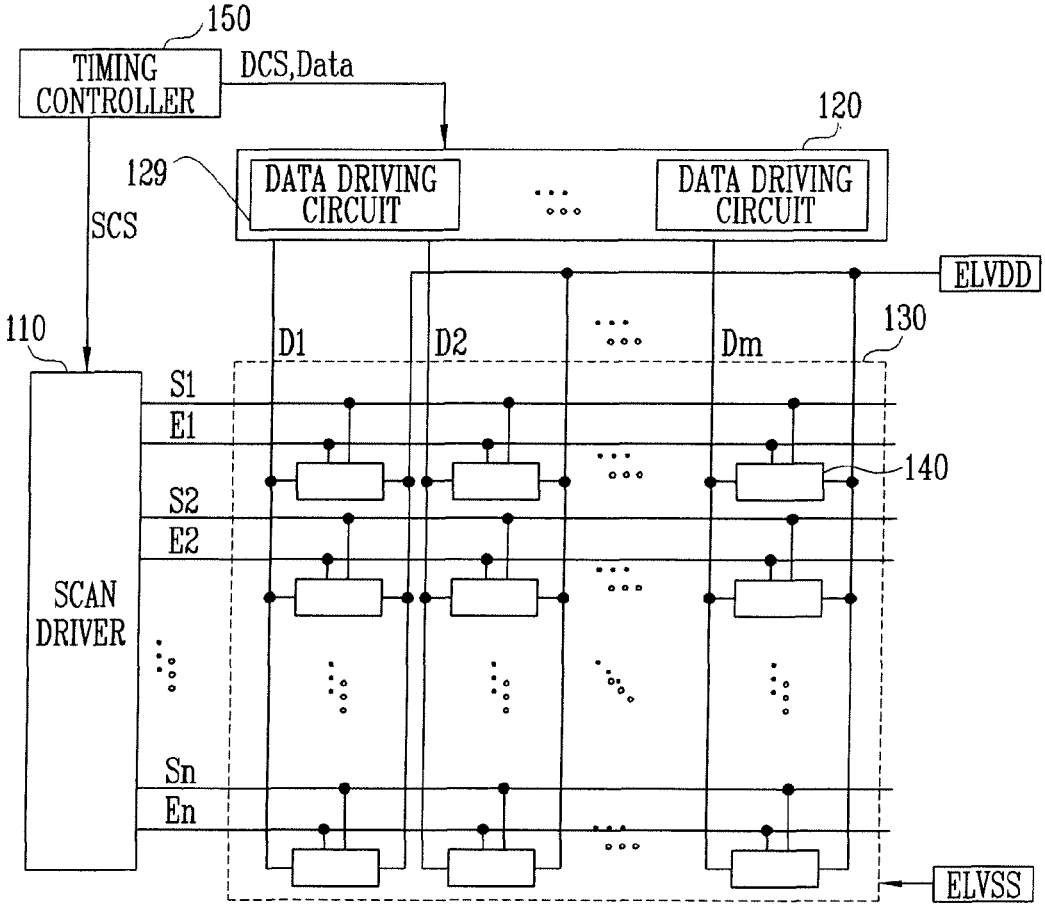
FIG. 5 illustrates a light emitting display device according to an embodiment of the present invention.

FIG. 5 illustrates a light emitting display device according to an embodiment of the present invention.

Referring to FIG. 5, a light emitting display device according to an embodiment of the present invention includes a display region 130 including a plurality of pixels 140 formed in regions defined by where a plurality of scan lines S1 through Sn cross with a plurality of data lines D1 through Dm; a scan driver 110 to drive the scan lines S1 through Sn; a data driver 120 to drive the data lines D1 through Dm; and a timing controller 150 to control the scan driver 110 and the data driver 120.

The scan driver 110 generates scan signals in response to scan control signals SCS from the timing controller 150, and supplies the scan signals to the scan lines S1 through Sn in sequence. Further, the scan driver 110 generates emission control signals in response to the scan control signals SCS, and supplies the emission control signals to a plurality of emission control lines E1 through En in sequence.

The data driver 120 generates data signals in response to data control signals DCS from the timing controller 150, and supplies the data signals to the data lines D1 through Dm. For this, the data driver 120 includes one or more data driving circuits 129. The data driving circuits 129 change data Data supplied from the outside into the data signals, and supplies the data signals to the data lines D1 through Dm. A detailed configuration of a data driving circuit 129 will be described later.

The timing controller 150 generates the data control signal DCS and the scan control signal SCS in response to synchronous signals supplied from the outside. The data control signal DCS and the scan control signal SCS generated by the timing controller 150 are supplied to the data driver 120 and the scan driver 110, respectively. Further, the timing controller 150 rearranges the data Data supplied from an external source, and supplies it to the data driver 120.

The display region 130 receives a first power from a first power source ELVDD and a second power from a second power source ELVSS from the outside. The first power source ELVDD and the second power source ELVSS respectively supply the first and second powers to the display region 130 such that the first and second powers are applied to the plurality of pixels 140. After receiving the first and second powers from the first power source ELVDD and the second power source ELVSS, respectively, the pixels 140 display an image corresponding to the data signals.

Figure 6:
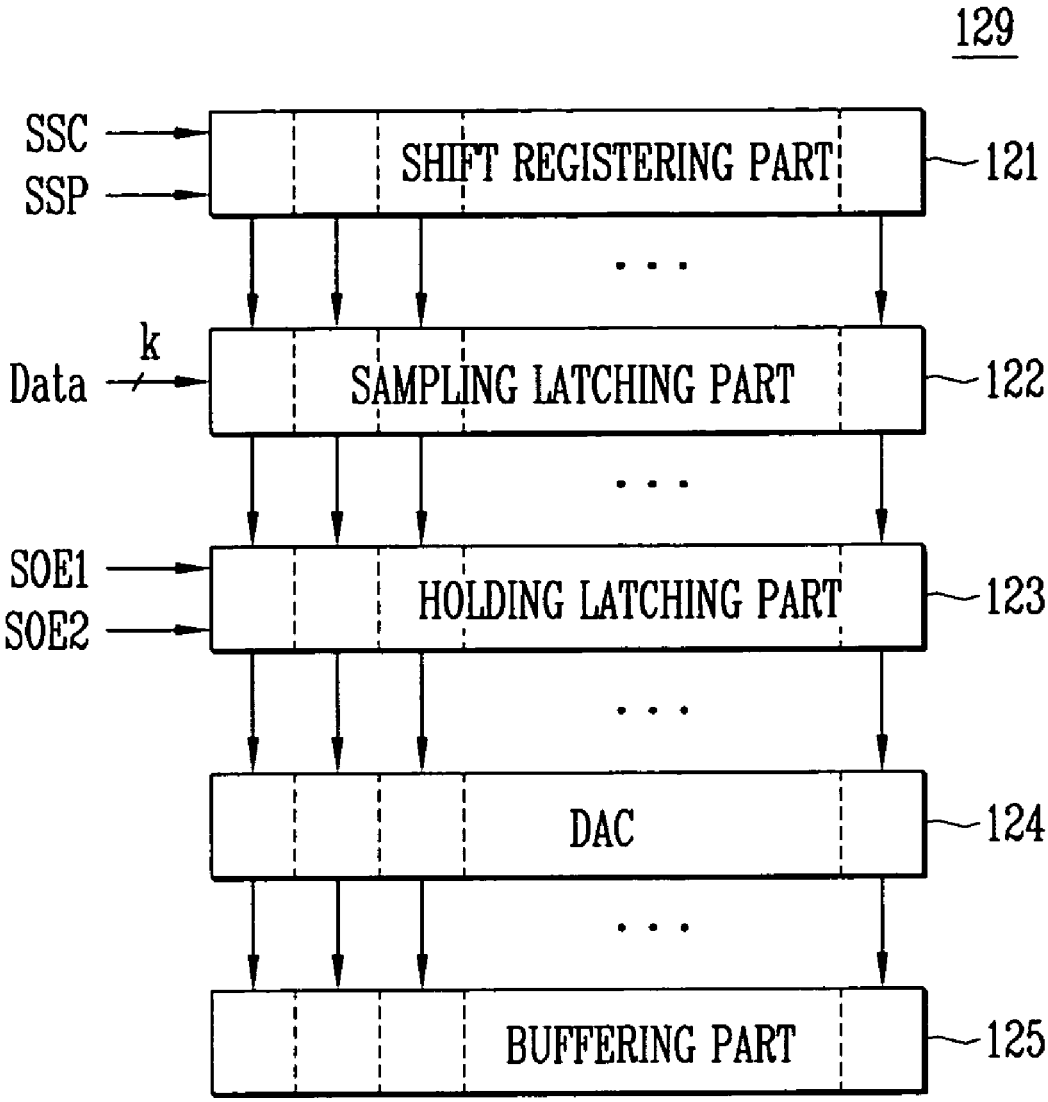
FIG. 6 is a schematic block diagram of a data driving circuit shown in FIG. 5.

FIG. 6 is a schematic block diagram of the data driving circuit 129 shown in FIG. 5.

Referring to FIG. 6, the data driving circuit 129 includes a shift registering part 121 to generate first sampling signals in sequence; a sampling latching part 122 to sequentially store the data Data in response to the first sampling signals; a holding latching part 123 to temporarily store the data Data stored in the sampling latching part 122 and supply the data Data to a DAC 124; the DAC 124 to generate data signals corresponding to digital values of the data Data; and a buffering part 125 to supply the data signals to the data lines Dl through Dm.

The shift registering part 121 receives a source shift clock SSC and a source start pulse (source start signal) SSP from the outside. After receiving the source shift clock SSC and the source start pulse SSP, the shift registering part 121 shifts the source start pulse SSP per one period of the source shift clock SSC, and generates the first sampling signals in sequence. For example, when the data driving circuit 129 has i channels, the shift registering part 121 generates i first sampling signals in sequence. Here, the $j^{th}$ first sampling signal is supplied while being overlapped with the $(j-1)^{th}$ first sampling signal as much as a period of time (where j is a natural number), wherein the period of time may be predetermined.

The sampling latching part 122 sequentially stores the data Data corresponding to the first sampling signal supplied (or sequentially supplied) from the shift registering part 121. Here, the sampling latching part 122 includes i sampling latches to store i data. Further, each of the sampling latches is set to store data Data of k bits.

The holding latching part 123 receives a first source output enable signal SOE1 and a second source output enable signal SOE2 from an external source. Here, the first and second source output enable signals SOE1 and SOE2 are supplied as being partially overlapped with each other in a first polarity (e.g., high polarity). The holding latching part 123 receives some data Data stored in the sampling latching part 122 while the first and second source output enable signals SOE1 and SOE2 are overlapped in the first polarity. Further, the holding latching part 123 receives the rest of the data Data while the first source output enable signal SOE1 maintains the first polarity and at the same time the second sampling signal SP1' or SP3' is supplied. Here, the second sampling signal SP1' or SP3' refers to a signal that is supplied to odd numbered shift registers (or even numbered shift registers) at the same time.

Further, the holding latching part 123 supplies some data Data to the DAC 124 while the first source output enable signal SOE1 and the second source output enable signal SOE2 maintain a second polarity (e.g., low polarity), and supplies the rest of the data Data to the DAC 124 while the second source output enable signal SOE2 maintains the first polarity. A detailed operation of the holding latching part 123 and the sampling latching part 122 will be described later.

The DAC 124 generates data signals corresponding to digital values of the data Data supplied from the holding latching part 123, and supplies the data signals to the buffering part 125.

The buffering part 125 supplies the data signals from the DAC 124 to the data lines D. Then, the pixels 140 emit light corresponding to the data signals.

Figure 7:
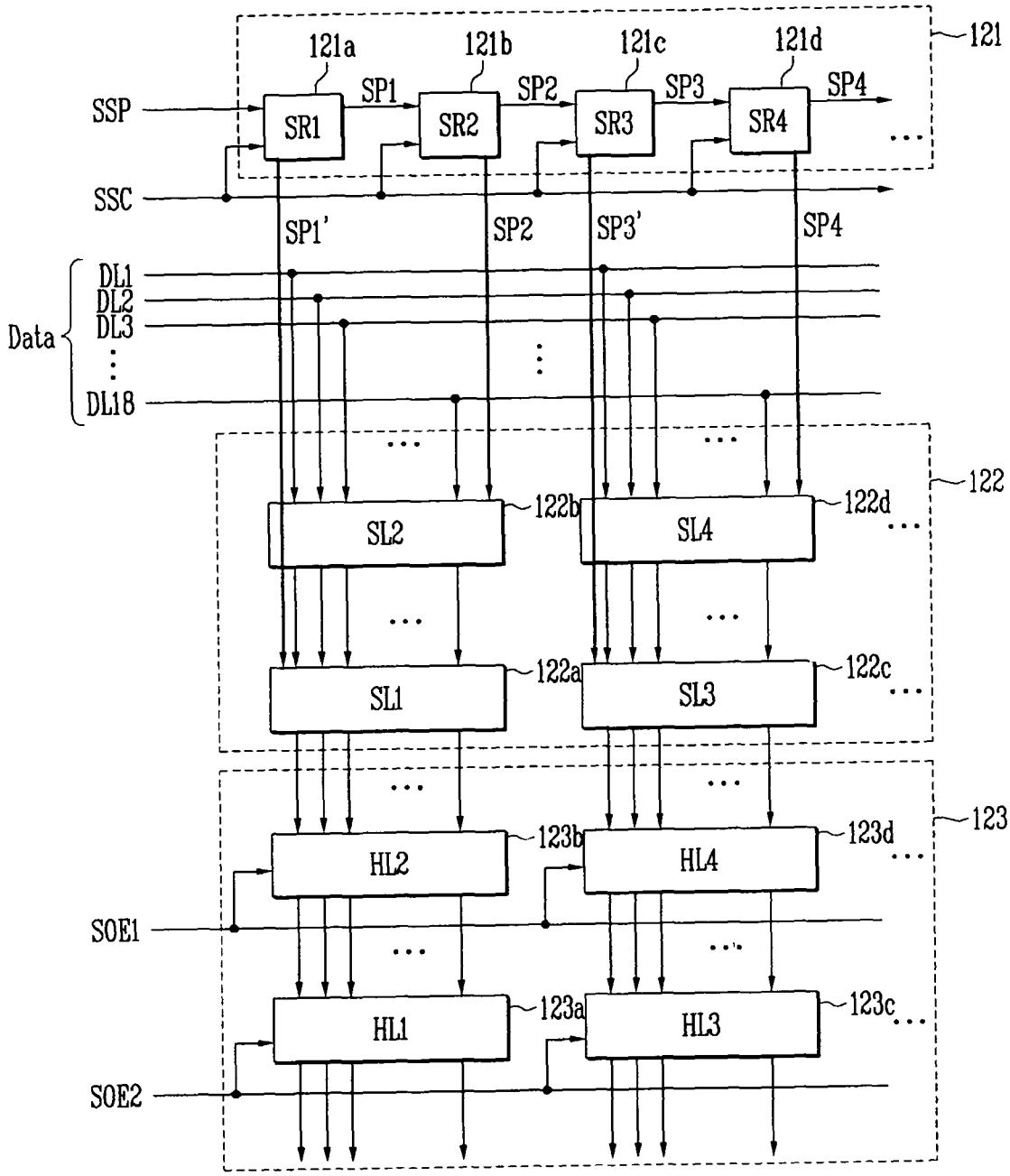
FIG. 7 illustrates a sampling latch and a holding latch shown in FIG. 6.

FIG. 7 illustrates a sampling latch and a holding latch shown in FIG. 6. For convenience of description, it is assumed that the data Data of FIG. 7 includes 18 bits.

Referring to FIG. 7, the sampling latching part 122 includes even numbered sampling latches 122*b*, 122*d* (SL2, SL4), . . . placed in an upper part, and odd numbered sampling latches 122*a*, 122*c* (SL1, SL3), . . . placed in a lower part.

The sampling latches 122*a*, 122*b*, 122*c*, 122*d* . . . receive the data Data from the transmission lines DL1, . . . , DL18 when the first sampling signal is supplied. Here, desired data Data is supplied to the sampling latch placed in the lower part for a period while the $j^{th}$ first sampling signal and the $(j-1)^{th}$ first sampling signal are overlapped with each other. Further, desired data Data is supplied to the sampling latch placed in the upper part for a period while only the $j^{th}$ first sampling signal is supplied.

The holding latching part 123 includes even numbered holding latches 123*b*, 123*d* (HL2, HL4), . . . placed in an upper part, and odd numbered holding latches 123*a*, 123*c* (HL1, HL3), . . . placed in a lower part.

The holding latches 123*a*, 123*c*, . . . placed in the lower part receive the data Data from the sampling latches 122*a*, 122*c*, . . . placed in the lower part for a period while the first source output enable signal SOE1 and the second source output enable signal SOE2 are set to have the first polarity. Further, the holding latches 123*b*, 123*d*, . . . placed in the upper part receive the data Data from the sampling latches 122*b*, 122*d*, . . . placed in the upper part for a period while the first source output enable signal SOE1 is set to have the first polarity. In this case, the second sampling signal SP1' or SP3' is supplied to the sampling latches 122*a*, 122*c*, . . . placed in the lower part so as to supply the data Data from the sampling latches 122*b*, 122*d*, . . . placed in the upper part to the holding latches 123*b*, 123*d*, . . . placed in the upper part.

Figure 8:
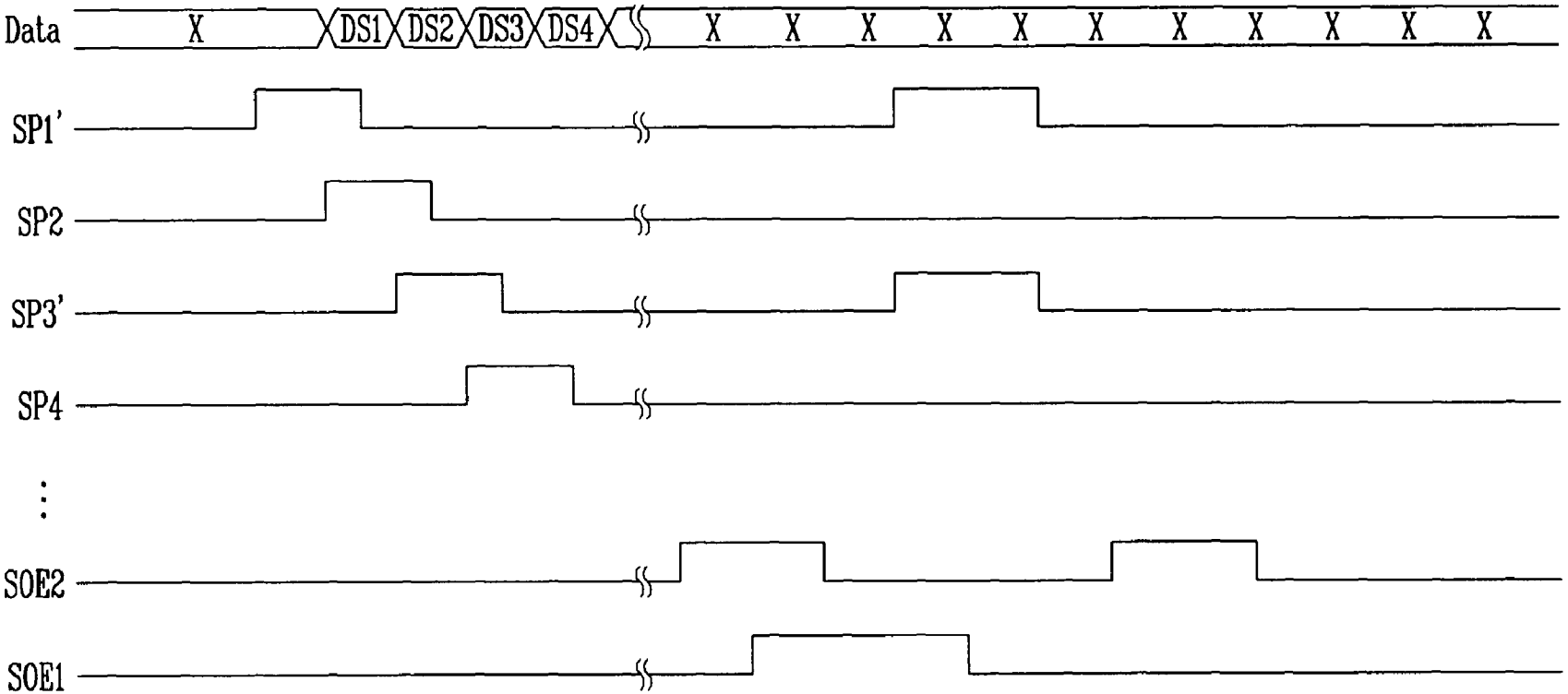
FIG. 8 shows waveforms of signals to be supplied to the sampling latch and the holding latch shown in FIG. 7.

Referring to the waveforms of FIG. 8, operation of the data driving circuit according to one embodiment of the present invention will be described. First, a first shift register 121*a* receives the source shift clock SSC and the source start pulse SSP from the outside. After receiving the source shift clock SSC and the source start pulse SSP, the first shift register 121*a* shifts the source start pulse SSP at a certain point (e.g., a rising edge or a falling edge) of the source shift clock SSC, thereby generating the first sampling pulse (or first sampling signal) SP1'.

Then, a second shift register 121*b* shifts a first sampling signal SP1' supplied from the first shift register 121*a* at a certain point of the source shift clock SSC, thereby generating a first sampling pulse SP2. Actually, the shift registers generate the first sampling pulses (or first sampling signals) at the certain points of the source shift clock SSC when the first sampling signals are supplied from the previous shift registers, and supply them to the subsequent shift registers, respectively.

Here, the first sampling signals are supplied to be overlapped with the respective previous first sampling signals for a period of time, which may be predetermined. For example, the first sampling signal SPj generated by the $j^{th}$ shift register 121*j* is supplied to be overlapped with the first sampling signal SPj−1 generated by the $(j-1)^{th}$ shift register 121*j*−1 for a period (or a predetermined period). For this, the shift registers 121*a*, 121*b*, 121*c*, 121*d* . . . can include a gate circuit such as NAND, NOR, AND, etc., so that the first sampling signals are generated as being overlapped.

When the first shift register 121*a* supplies the first sampling signal SP1' and the second shift register 121*b* supplies the first sampling signal SP2, the data Data is supplied from the transmission lines DL1 through DL18 to the first sampling latch 122*a* via the second sampling latch 122*b*. Further, when the first shift register 121*a* stops supplying the first sampling signal SP1' and the first sampling signal SP2 is supplied to only the second sampling latch 122*b*, the second sampling latch 122*b* receives the data Data through the transmission lines DL1 through DL18.

Hence, according to one embodiment of the present invention, when the $j^{th}$ first sampling signal SPj and the $(j-1)^{th}$ first sampling signal SPj−1 are supplied concurrently, the data Data is inputted to the $(j-1)^{th}$ sampling latch 122*j*−1 placed in the lower part. Further, when the $(j-1)^{th}$ first sampling signal SPj−1 is not supplied and the $j^{th}$ first sampling signal SPj is supplied, the data Data is inputted to the $j^{th}$ sampling latch 122*j*. Thus, the data Data is supplied to the sampling latches 122*a*, 122*c* placed in the lower part via the sampling latches 122*b*, 122*d*, so that the number of wiring lines is reduced, thereby reducing or minimizing the size of the data driving circuit 129.

After storing the data Data in all sampling latches 122*a*, 122*b*, 122*c*, 122*d*. . . , the second source output enable signal SOE2 and the first source output enable signal SOE1 are supplied as being overlapped in the first polarity for a period, which may be predetermined. When the second source output enable signal SOE2 and the first source output enable signal SOE1 are supplied as being overlapped in the first polarity, the data Data stored in the sampling latches 122*a*, 122*c*, . . . placed in the lower part is inputted to the holding latches 123*a*, 123*c*, . . . placed in the lower part via the holding latches 123*b*, 123*d*, . . . placed in the upper part.

Then, the second source output enable signal SOE2 is changed to have the second polarity. At the same time, the second sampling signal SP1' or SP3' is supplied to the sampling latches 122*a*, 122*c*, . . . while being overlapped with the first source output enable signal SOE1 in the first polarity. Then, the data Data stored in the sampling latches 122*b*, 122*d*, . . . placed in the upper part is inputted to the holding latches 123*b*, 123*d*, . . . placed in the upper part via the sampling latches 122*a*, 122*c*, . . . placed in the lower part. Thus, the data Data is supplied to the sampling latches 122*a*, 122*c*, . . . placed in the lower part via the sampling latches 122*b*, 122*d*, . . . placed in the upper part, so that the number of wiring lines is reduced, thereby reducing or minimizing the size of the data driving circuit 129.

Here, the second sampling signal SP1' or SP3' can be supplied by various methods. For example, a circuit for supplying the second sampling signal SP1' or SP3' may be added to the shift registering part 121. Further, the second sampling signal SP1' or SP3' may be supplied from the timing controller 150.

After inputting the data Data to the holding latches 123*b*, 123*d*, . . . placed in the upper part, the second sampling signal is not supplied SP1' or SP3'. Further, the first source output enable signal SOE1 and the second source output enable signal SOE2 are maintained to have the second polarity. At this time, the DAC 124 receives the data Data from the holding latches 123*a*, 123*c*, . . . placed in the lower part.

After the data Data is supplied from the holding latches 123*a*, 123*c*, . . . to the DAC 124, the second enable signal SOE2 is converted to have the first polarity. At this time, the DAC 124 receives the data Data from the holding latches 123*b*, 123*d*, . . . placed in the upper part via the holding latches 123*a*, 123*c*, . . . placed in the lower part. Thus, the data Data is supplied from the upper holding latches 123*b*, 123*d*, . . . to the DAC 124 via the lower holding latches 123*a*, 123*c*, . . . , so that the number of wiring lines needed for transmitting the data Data is minimized, thereby minimizing the volume of the data driving circuit 129. Further, the data Data is supplied from the upper holding latches 123*b*, 123*d*, . . . to the DAC 124 via the lower holding latches 123*a*, 123*c*, . . . , so that the demultiplexers are not needed, thereby decreasing the volume and the production cost.

The DAC 124 generates the data signal corresponding to the digital value of the data Data supplied thereto, and supplies the generated data signal to the buffering part 125. Then, the buffering part 125 supplies the data signal to the data line D so as to make the pixels 140 display a predetermined image.

As described above, exemplary embodiments of the present invention provide a data driving circuit, a light emitting display device using the same and a driving method thereof, in which the data stored in the upper sampling latches is supplied to the upper holding latches via the lower sampling latches. Further, the data stored in the upper holding latches is supplied to the DAC via the lower holding latches. Thus, the data of the upper sampling and holding latches is respectively supplied via the lower sampling and holding latches, so that the number of wiring lines is reduced or minimized, thereby decreasing the size of the data driving circuit.

Although certain exemplary embodiments of the present invention have been shown and described, it would be appreciated by those skilled in the art that changes might be made to these embodiments without departing from the principles and spirit of the invention, the scope of which is defined in the claims and their equivalents.

What is claimed is:

1. A data driving circuit comprising:

a plurality of shift registers for generating first sampling signals in sequence;

a plurality of sampling latches arranged as first sampling latches and second sampling latches, the sampling latches being adapted to receive data when the first sampling signals are supplied and the first sampling latches being configured to receive data via the second sampling latches; and a plurality of holding latches controlled by a first source output enable signal and a second source output enable signal, the holding latches being adapted to receive the data stored in the sampling latches, wherein the second sampling latches are configured to supply data to the holding latches via the first sampling latches and wherein a first shift register of the plurality of shift registers is configured to supply the corresponding first sampling signal to a first one of the first sampling latches and a second shift register of the plurality of shift registers is configured to supply the corresponding first sampling signal to a first one of the second sampling latches.

2. The data driving circuit according to claim 1, wherein a jth one of the first sampling signals is supplied to overlap with a (j−1)th one of the first sampling signals for a period predetermined period and j is a natural number and greater than one.

3. The data driving circuit according to claim 2, wherein a first portion of the data is supplied to a (j−1)th one of the first sampling latches via a jth one of the second sampling latches when the jth one of the first sampling signals is overlapped with the (j−1)th one of the first sampling signals, and a second portion of the data is supplied to the jth one of the second sampling latches when only the jth one of the first sampling signals is supplied.

4. The data driving circuit according to claim 1, wherein the holding latches comprise:

a plurality of first holding latches placed in an first area, the first holding latches being adapted to receive the data from the first sampling latches; and a plurality of second holding latches placed in a second area, the second holding latches being adapted to receive the data from the second sampling latches.

5. The data driving circuit according to claim 4, wherein the first holding latches receive the data stored in the first sampling latches via the second holding latches when the first source output enable signal and the second source output enable signal maintain a first polarity.

6. The data driving circuit according to claim 5, wherein a second sampling signal is supplied to the first sampling latches while being at least partially overlapped with the first source output enable signal in the first polarity after storing the data in the first holding latches.

7. The data driving circuit according to claim 6, wherein the data stored in the second sampling latches is supplied to the second holding latches via the first sampling latches while the second sampling signal and the first source output enable signal are overlapped in the first polarity.

8. A data driving circuit comprising:

a plurality of shift registers for generating first sampling signals in sequence;

a plurality of sampling latches arranged as first sampling latches and second sampling latches, the sampling latches being adapted to receive data when the first sampling signals are supplied and the first sampling latches being configured to receive data via the second sampling latches; and a plurality of holding latches controlled by a first source output enable signal and a second source output enable signal, the holding latches being adapted to receive the data stored in the sampling latches, wherein second sampling latches are configured to supply data to the holding latches via the first sampling latches and wherein a first shift register of the plurality of shift registers is configured to supply a corresponding first sampling signal of the first sampling signals to a first one of the first sampling latches and a second shift register of the plurality of shift registers is configured to supply a corresponding first sampling signal of the first sampling signals to a first one of the second sampling latches, wherein the holding latches comprise:

a plurality of first holding latches placed in an first area, the first holding latches being adapted to receive the data from the first sampling latches; and a plurality of second holding latches placed in a second area, the second holding latches being adapted to receive the data from the second sampling latches, wherein the first holding latches receive the data stored in the first sampling latches via the second holding latches when the first source output enable signal and the second source output enable signal maintain a first polarity, wherein a second sampling signal is supplied to the first sampling latches while being at least partially overlapped with the first source output enable signal in the first polarity after storing the data in the first holding latches, wherein the data stored in the second sampling latches is supplied to the second holding latches via the first sampling latches while the second sampling signal and the first source output enable signal are overlapped in the first polarity, wherein after storing the data in the first and second holding latches, the data stored in the first holding latches is supplied to a digital-analog converter while the first source output enable signal and the second source output enable signal maintain a second polarity, and the data stored in the second holding latches is supplied to the digital-analog converter via the first holding latches when the second source output enable signal maintains the first polarity.

9. The data driving circuit according to claim 8, wherein the first polarity has a higher voltage level than the second polarity.

10. The data driving circuit according to claim 8, wherein the first sampling latches are lower sampling latches and wherein the second sampling latches are upper sampling latches.

11. The data driving circuit according to claim 10, wherein the first holding latches are lower holding latches and wherein the second holding latches are upper holding latches.

12. The data driving circuit according to claim 8, wherein the second sampling signal is not supplied to the first sampling latches.

13. The data driving circuit according to claim 8, wherein the second sampling signal has a voltage level substantially similar to the first polarity.

14. The data driving circuit according to claim 8, wherein the second sampling signal has a higher voltage level than the second polarity.

15. A light emitting display device comprising:

a scan driver adapted to supply scan signals to scan lines;

a data driver comprising at least one data driving circuit adapted to supply data signals to data lines;

a display region comprising pixels placed in regions defined by where the scan lines cross the data lines, the pixels being adapted to generate light corresponding to the data signals, the at least one data driving circuit comprising:

a plurality of shift registers for generating sampling pulses in sequence;

a plurality of sampling latches arranged as first sampling latches and second sampling latches, the sampling latches being adapted to receive data when the sampling pulses are supplied and the first sampling latches being configured to receive data via the second sampling latches; and a plurality of holding latches arranged as first holding latches and second holding latches, the holding latches being adapted to receive the data stored in the sampling latches, wherein the first sampling latches are configured to supply data to the first holding latches via the second holding latches and wherein a first shift register of the plurality of shift registers is configured to supply a corresponding sampling pulse of the sampling pulses to a first one of the first sampling latches and a second shift register of the plurality of shift registers is configured to supply a corresponding sampling pulse of the sampling pulses to a first one of the second sampling latches.

16. The light emitting display device according to claim 15, wherein the first sampling latches are lower sampling latches and the second sampling latches are upper sampling latches.

17. The light emitting display device according to claim 15, wherein a portion of the data stored in at least one of the second sampling latches is supplied to a corresponding one of the second holding latches via a corresponding one of the first sampling latches.

18. The light emitting display device according to claim 17, wherein the portion of the data stored in the corresponding one of the second holding latches is supplied to a digital-analog converter via a corresponding one of the first holding latches.

19. A method of driving a light emitting display device, the method comprising:

applying a first sampling signal to a first sampling latch and a second sampling signal to a second sampling latch to store first data in the first sampling latch via the second sampling latch;

applying the second sampling signal to the second sampling latch to store second data in the second sampling latch;

supplying the first data from the first sampling latch to a first holding latch via a second holding latch; and supplying the second data from the second sampling latch to the second holding latch via the first sampling latch.

20. The method according to claim 19, wherein a portion of the data stored in the second holding latch is supplied to a digital-analog converter via the first holding latch.

21. The method according to claim 19, wherein the first sampling latch is a lower sampling latch and the second sampling latch is an upper sampling latch.

* * * * *

UNITED STATES PATENT AND TRADEMARK OFFICE

CERTIFICATE OF CORRECTION

PATENT NO. : 7,821,484 B2
APPLICATION NO. : 11/517762
DATED : October 26, 2010
INVENTOR(S) : Sang Moo Choi It is certified that error appears in the above-identified patent and that said Letters Patent is hereby corrected as shown below:

In the Claims

| | |
|---|---|
| Column 9, Claim 2, line 53 | After "a" delete "." |
| Column 9, Claim 4, line 66 | Delete "an"<br>Insert -- a -- |
| Column 10, Claim 8, line 32 | After "wherein" insert -- the -- |
| Column 10, Claim 8, line 42 | Delete "an"<br>Insert -- a -- |

Signed and Sealed this
Twenty-second Day of November, 2011

David J. Kappos

David J. Kappos
*Director of the United States Patent and Trademark Office*